United States Patent [19]

Roach et al.

[11] Patent Number: 4,770,006

[45] Date of Patent: Sep. 13, 1988

[54] HELIUM DILUTION REFRIGERATION SYSTEM

[75] Inventors: Patrick R. Roach, Darien; Kenneth E. Gray, Naperville, both of Ill.

[73] Assignee: Arch Development Corp., Chicago, Ill.

[21] Appl. No.: 45,886

[22] Filed: May 1, 1987

[51] Int. Cl.[4] ..... F25B 19/00

[52] U.S. Cl. ..... 62/514 R

[58] Field of Search ..... 62/467, 514 R

[56] References Cited

U.S. PATENT DOCUMENTS

| | | | |
|---|---|---|---|
| 3,835,662 | 9/1974 | Staas et al. | 62/514 R |
| 3,896,630 | 7/1975 | Severijns et al. | 62/514 R |
| 3,978,682 | 9/1976 | Severijns et al. | 62/514 R |
| 3,992,893 | 11/1976 | Claudet et al. | 62/467 |
| 4,136,526 | 1/1979 | Chanin et al. | 62/514 R |
| 4,296,609 | 10/1981 | Severijns et al. | 62/514 R |
| 4,297,856 | 11/1981 | Staas et al. | 62/514 R |
| 4,300,360 | 11/1981 | Chanin et al. | 62/514 R |
| 4,672,823 | 6/1987 | Benoit et al. | 62/514 R |

OTHER PUBLICATIONS

"Experiments on Dilution of $^3$He with $^4$He at Very Low Temperatures," Phys. Lettr. 24A, 344 (May 1967); O. E. Vilches and J. C. Wheatley.

Appendix III, "A Novel Helium Dilution Refrigerator" master of science thesis entitled, "A High Responsivity, Low Noise Germanium Bolometer for the Far Infrared" submitted in Jul. 1974 to Cornell University; Bruce T. Draine.

V. A. Mikheev, V. A. Maidanov and N. P. Mikhin, "Small Size Dilution Refrigerator with a Cryogenic Circulation Cycle of He," Proceedings of the Tenth International Cryogenic Engineering Conf., Helsinki, Finland, Jul. 1984.

*Primary Examiner*—Ronald C. Capossela

*Attorney, Agent, or Firm*—Michael D. Rechtin

[57] ABSTRACT

A helium dilution refrigeration system operable over a limited time period, and recyclable for a next period of operation. The refrigeration system is compact with a self-contained pumping system and heaters for operation of the system. A mixing chamber contains $^3$He and $^4$He liquids which are precooled by a coupled container containing $^3$He liquid, enabling the phase separation of a $^3$He rich liquid phase from a dilute $^3$He-$^4$He liquid phase which leads to the final stage of a dilution cooling process for obtaining low temperatures. The mixing chamber and a still are coupled by a fluid line and are maintained at substantially the same level with the still cross sectional area being smaller than that of the mixing chamber. This configuration provides maximum cooling power and efficiency by the cooling period ending when the $^3$He liquid is depleted from the mixing chamber with the mixing chamber nearly empty of liquid helium, thus avoiding unnecessary and inefficient cooling of a large amount of the dilute $^3$He-$^4$He liquid phase.

17 Claims, 2 Drawing Sheets

HELIUM DILUTION REFRIGERATION SYSTEM

This invention was made with U.S. Government support under contract number W-31-109-ENG-38 awarded by the U.S. Department of Energy. The Government has certain rights in the invention.

This invention is related generally to a helium dilution refrigeration system operable in a cooling mode for a limited time period and then recycled for subsequent operation. More particularly, the invention is related to a helium dilution refrigeration system which has a relatively simple structure with all major components self-contained within a compact unit. The refrigeration system further includes a mixing chamber coupled to a helium still of small cross sectional area which is maintained at substantially the same level as the mixing chamber. At the end of the cooling cycle the mixing chamber is nearly empty, and the cooling power of the refrigeration system has not been wasted cooling large amounts of a dilute phase. The system also minimizes extra heat load by operating without the need to recycle through the mixing chamber that portion of the $^3$He pumped from the still.

Previously, there have been developed $^3$He-$^4$He dilution refrigeration systems of the continuously operating type for providing temperatures from 1.0° K. down to 0.002° K. Such helium dilution refrigeration systems are based on the cooling that is achieved when $^3$He crosses a phase boundary separating concentrated $^3$He from a dilute mixture of 6% $^3$He and $^4$He. This dilution cooling process takes place in a mixing chamber, which is the coldest region of the refrigeration system; and experimental samples are attached to this mixing chamber. The flow of $^3$He across the phase boundary is driven by the removal of $^3$He from the dilute phase in a separate, but coupled chamber called a still. The still is thermally isolated from the mixing chamber but is connected to the mixing chamber by a thin tube containing liquid helium. The temperature of the still is maintained by a heater at a constant temperature such that the vapor above the dilute liquid phase is nearly pure $^3$He. A vacuum pump removes this $^3$He component from the still, leaving the $^4$He behind as a stationary background phase. In a continuously operating system the $^3$He is compressed, cooled to about 1° K. to cause liquefaction, and the $^3$He liquid is returned to the mixing chamber. In these continues refrigeration systems, the heat load of the returning $^3$He on the mixing chamber is minimized by precooling the returning $^3$He with a complex heat exchanger system. Such dilution refrigeration systems also include $^4$He chambers in which liquid $^4$He is cooled by evaporation cooling through use of an external vacuum pump. A continuous dilution refrigeration system will also require additional external pumps, storage tanks for the $^3$He and $^4$He gas mixture, various traps for cleaning the $^3$He before being returned to the cryostat, large diameter pumping lines connected to the cryostat and numerous valves and sensors for operation of the system. In general, continuous dilution refrigeration systems require a complex structure and thus necessitate extensive training and experience on the part of the system operators. Such systems are also quite expensive to purchase.

BRIEF SUMMARY OF THE INVENTION

One of the primary objects of the invention is to provide an improved helium dilution refrigeration system.

It is another object of the invention to provide a novel helium dilution refrigeration system having a compact design and being relatively inexpensive to construct.

It is a further object of the invention to provide an improved helium dilution refrigeration system having a mixing chamber and a still positioned relative to one another to help optimize the cooling power of the system.

It is an additional object of the invention to provide a novel helium dilution refrigeration system of optimize cooling power and minimize contamination of the system by not returning to the mixing chamber the $^3$He evaporated from the still.

In accordance with the invention, a helium dilution refrigeration apparatus and method is provided for cooling purposes over a limited time period. The refrigeration apparatus is a compact system with self-contained pumps and heaters for controlling operation of the system. The apparatus has a highly efficient design and is relatively inexpensive to construct. In particular, a helium liquid mixing chamber and still are coupled and maintained at nearly the same level such that the liquid levels are nearly the same. The helium still cross sectional area is much smaller than the mixing chamber cross sectional area. This configuration provides maximum cooling power with the period of cooling ending as the $^3$He is depleted from the mixing chamber, and at the same time the mixing chamber is nearly empty of liquid helium. This configuration prevents unnecessary cooling of a large amount of a dilute $^3$He-$^4$He phase which otherwise would exist in the mixing chamber. The system preferably also includes a precooling chamber of liquid $^3$He cooled by evaporative cooling arising from pumping on the chamber. This precooling reduces the temperature of the mixing chamber below about 0.8° K., causing phase separation into a concentrated $^3$He phase and a dilute $^3$He-$^4$He phase. The $^3$He crossing the phase boundary between these two phases into the dilute phase embodies a dilution cooling process which is the final stage of cooling to the lowest temperature for the refrigeration system. The $^3$He vapor pumped from the still during this dilution cooling process is collected in a cryopump positioned internal to the system, thereby avoiding contamination effects. In addition, an extra heat load on the system is avoided because the $^3$He vapor is not returned to the mixing chamber during the period of cooling.

Further objects and advantages of the invention, together with the organization and operation thereof, will become apparent from the following detailed description of the invention when taken in conjunction with the accompanying drawings.

DETAILED DESCRIPTION OF PREFERRED EMBODIMENTS

Figure 1:
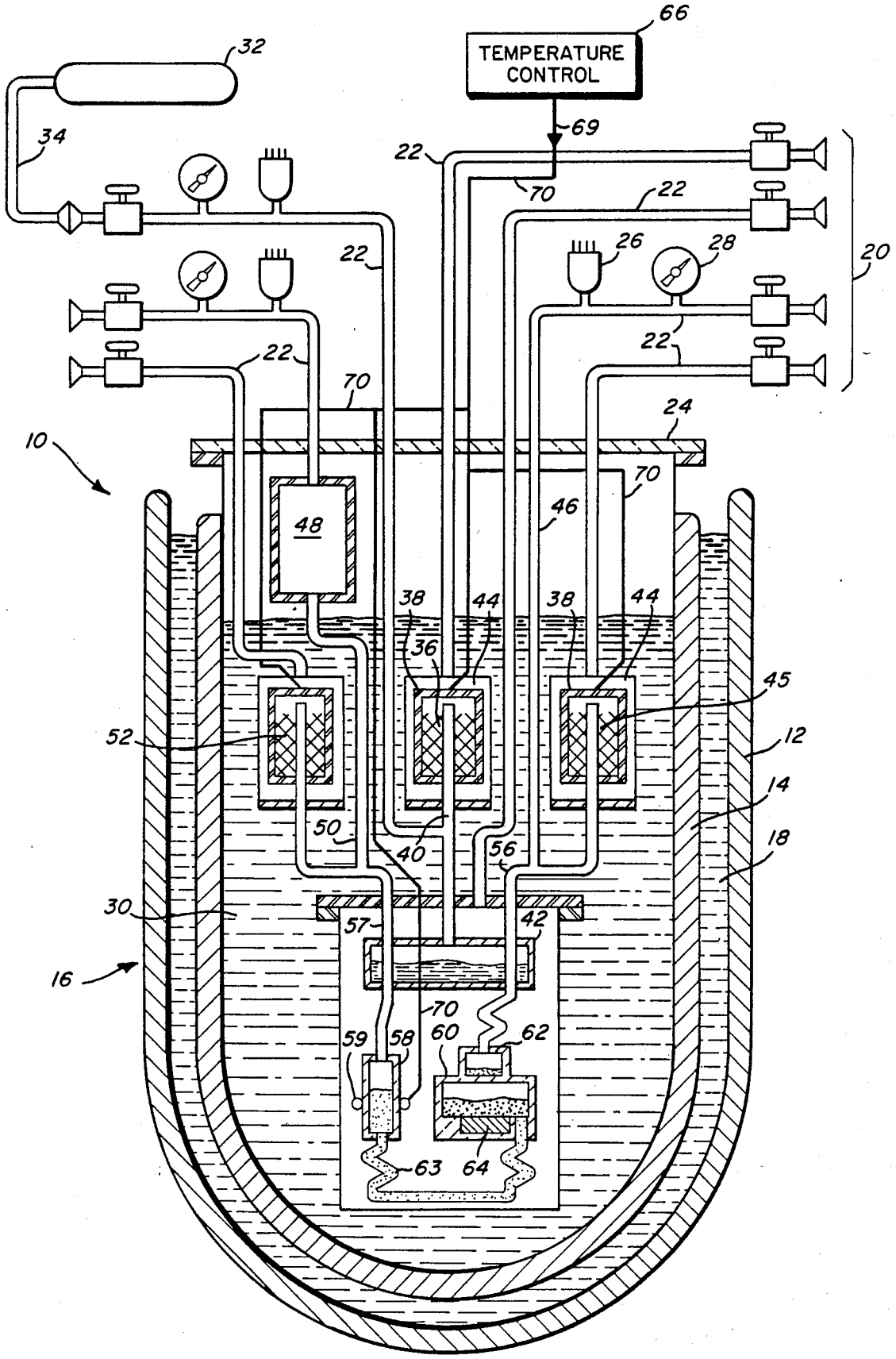
FIG. 1 is an elevation view in cross section of a helium dilution refrigeration system constructed in accordance with the invention.

Referring now to the drawings and in particular to FIG. 1, a helium dilution refrigeration system constructed in accordance with the invention is generally indicated at 10. The helium dilution refrigeration system 10 (hereinafter, the system 10) is supported generally by walls 12 and 14 of a containment vessel, such as a cryostat 16. The walls 12 and 14 are evacuated to provide a thermal barrier with liquid nitrogen 18 disposed between the cryostat walls 12 and 14. The system 10 has a gas handling portion 20 exterior to the cryostat 16 with a number of connecting tubes 22 passing through a cover plate 24. The gas handling portion 20 includes various vacuum sensors 26 and pressure sensors 28.

Within the cryostat 16 are selected portions of a pumping and cooling system. Initial cooling to 77° K. over several hours is performed by a bath 30 of liquid nitrogen which is subsequently removed from the cryostat 16 and replaced with liquid helium at 4.2° K. When the system 10 is at room temperature, the $^4$He used in the cooling process is stored in a compressed gas form at about 70 psi in a storage tank 32. The $^4$He is initially bled into the system 10 when at low temperatures with the $^4$He gas passed through a conduit 34 and adsorbed onto the charcoal of a first cryopump 36. The active cooling cycle begins by raising the temperature of the cryopump 36 to almost 40° K. using heating means, such as a heater 38. The $^4$He gas given off by the cryopump 36 during the heating process is condensed on the internal walls of a conduit 40 cooled by the bath 30 of liquid helium, and the condensed liquid $^4$He runs into a container 42 (see FIG. 2). When the container 42 is substantially full of liquid $^4$He, the cryopump 36 is cooled by letting gas into a vacuum jacket region 44 which otherwise isolates the cryopump 36 from the bath 30. The cryopump 36 pumps on the liquid $^4$He in the container 42 causing evaporative cooling of the container 42 to about 1.0° K. In other forms of the invention, the container 42 can be filled with $^4$He liquid from the bath 30 consisting essentially of liquid helium.

Figure 2:
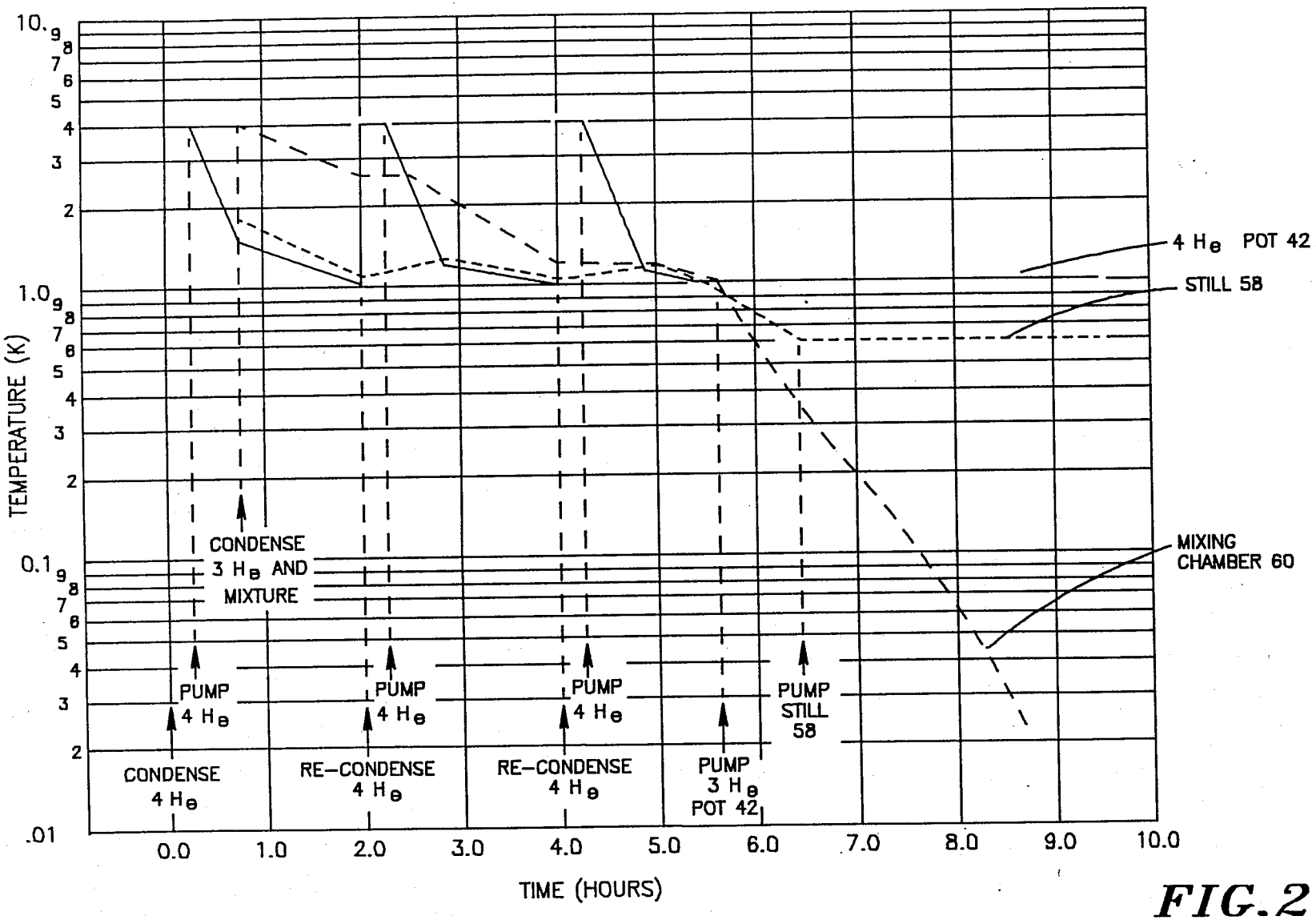
FIG. 2 is an example of a complete temperature history diagram over a period of operation of various selected portions of the refrigeration system.

In the preferred embodiment, the cooled container 42 reaches about 1.0° K. and is used to precool and liquify other helium gas sources as the system 10 continues through its period of cooling in the manner shown in FIG. 2. In other forms of the invention alternative means for liquifying helium gases, such as any conventional device for cooling below 4° K. gases of $^3$He and $^3$He-$^4$He, can be used in place of the container 42 holding liquid $^4$He. In the embodiment of FIG. 1, a second cryopump 45 contains adsorbed $^3$He which was provided to the system 10 in a manner similar to the input of $^4$He described hereinbefore. A means for supplying a mixture of $^3$He and $^4$He gases, such as a mixture storage tank 48, provides gaseous $^3$He and $^4$He through an inlet conduit 50 to a third cryopump 52 which adsorbs the gaseous helium mixture. Subsequently, both the second cryopump 45 and the third cryopump 52 are heated to drive off their adsorbed helium gases. These desorbed helium gases then condense from the second cryopump 45 and third cryopump 52 on the inside walls of input conduits 56 and 57, respectively, which pass through the container 42 held at roughly 1° K. The mixture of $^3$He and $^4$He liquid runs into a still 58 and a coupled mixing chamber 60. The $^3$He liquid runs into means for collecting $^3$He liquid, such as a $^3$He pot 62, thermally coupled to the mixing chamber 60. As shown in the example operation of FIG. 2 at this point in the operation of the system 10, the $^4$He container 42 is at about 1.5° K. and continuing to cool due to the pumping by the cryopump 36. At the same time, the still 58 is at roughly 1.8° K. and the mixing chamber 60 is at approximately 4° K. Further cooling of the system 10 is carried out in the manner shown in FIG. 2 and involves repeatedly recondensing liquid $^4$He for the container 42 and cryopumping thereon.

The system 10 eventually reduces the temperature of the mixing chamber 60 by utilizing the cooling effect caused by $^3$He crossing the phase boundary between a first phase of concentrated $^3$He liquid which has been separated from a second dilute liquid phase of $^3$He and $^4$He. This dilution cooling takes place in containing means, such as the mixing chamber 60. In order to create this phase separation, the temperature of the mixing chamber 60 should be cooled to below about 0.8° K., and this is preferably accomplished by the $^3$He pot 62 thermally coupled to the mixing chamber 60. Therefore, at this point in the cooling operation of the system 10, the $^3$He pot 62 is pumped on by the second cryopump 45, causing evaporative cooling of the $^3$He pot 62 which in turn causes the thermally coupled mixing chamber 60 to cool below 0.8° K. This cooling operation causes the mixing chamber 60 to cool to a temperature of about 0.3° K. to establish the phase separation before undergoing a further temperature decrease from the dilution cooling process.

The dilution cooling process is driven by pumping on the still 58 which is a means for holding the second phase of dilute $^3$He and $^4$He. A heater 59 maintains the still 58 at a temperature which causes $^3$He rich vapor formation above the liquid helium in the still 58. The still 58 is in communication with the mixing chamber 60 by connecting conduit 63 which contains the second phase in a continuous liquid path. The still 58 and the mixing chamber 60 are supported at about the same vertical position such that the liquid levels are nearly the same in the still 58 and the mixing chamber 60. The still 58 is pumped on by the third cryopump 52, and $^3$He vapor is preferentially removed, thus driving the dilution cooling process in the mixing chamber 60. In the example period of cooling shown in FIG. 2, the temperature of the still 58 is at about 0.6° K. before starting phase separation cooling. A further decrease in temperature of the mixing chamber 60 occurs in the manner shown in FIG. 2. Nearly nine hours after starting the cool down process of the system 10, the temperature is in the vicinity of roughly 0.02° K. This dilution cooling process continues until depletion of the concentrated $^3$He liquid phase in the mixing chamber 60. At this end point, the mixing chamber 60 is substantially empty of liquid helium, and thus the cooling power of the system 10 has not been wasted on cooling large quantities of the second phase of $^3$He and $^4$He liquid. This advantage arises from the still 58 being positioned at substantially the same level as the mixing chamber 60 and the still 58 also having a relatively small cross sectional area compared to the cross sectional area of the mixing chamber 60. This configuration allows careful control of the helium liquid levels and the amount of helium liquid in the still 58 and the mixing chamber 60. Therefore, as the dilution cooling process proceeds to its end point, the volume of liquid helium in the mixing chamber 60 diminishes such that the cooling power goes into cooling the metal of the mixing chamber 60 and an attached sintered copper powder heat sink 64. Consequently, the efficiency reaches an optimum near the end point, and the temperature approaches a minimum when the liquid helium volume is near a minimum in the mixing chamber 60.

The system 10 also contains a substantially constant amount of $^3$He (held in the second cryopump 52, in the still 58 or in the mixing chamber 60). The $^3$He gas removed from the still 58 during the cooling process is adsorbed by the second cryopump 52 and is not returned either to the mixing chamber 60 or the still 58 until the next operational period of the system 10. This approach avoids placing an extra heat load on the mixing chamber 60 in the form of the warmed $^3$He. If the $^3$He were returned to the mixing chamber 60, this would diminish the efficiency, raise the lower limit of temperature attainable and also reduce the useful time of operation of system 10. Furthermore, the use of self-contained cryopumps as storage means for the $^3$He avoids contamination of $^3$He which could occur if externally stored or pumped through an external pumping system.

Operation of the system 10 is readily handled by a self-contained heating means, such as the resistance heaters 38 and heater 59. Various control means can be used to control the heater 38 and the heater 59 which enable operation of the system 10 during the cooling period. The control means can be, for example, a computer 66 and associated stored computer programs for monitoring physical parameters, such as gas pressure levels through the vacuum sensors 26 and pressure sensors 28. Control signals 68 are output along wires 70 to the resistance heaters 38 and the heater 59 responsive to the computer 66 monitoring the gas pressure levels and executing the associated computer programs.

The helium dilution refrigeration system is a compact and self-contained apparatus capable of achieving at least about 0.02° K. and is relatively inexpensive to construct. A collection of cooling features for the system provides a highly efficient cooling process with little or no contamination of $^3$He used in the system.

While preferred embodiments and examples of the present invention have been illustrated and described, it will be understood that changes and modifications can be made without departing from the invention in the broader aspects. Various features of the invention are set forth in the following claims.

What is claimed is:

1. A helium dilution refrigeration system operable over a limited time period for cooling purposes, comprising:

means for suppplying a mixture of $^3$He and $^4$He gas;
means for cooling selected portions of said refrigeration system to liquid helium temperatures;
means for liquifying helium gases;
means for collecting $^3$He liquid condensed from $^3$He gas cooled by said means for liquifying helium gases;
means for containing a mixture of $^3$He and $^4$He liquid condensed from said $^3$He and $^4$He gas cooled by said means for liquifying, said containing means cooled by said means for collecting $^3$He liquid and said collecting means causing cooling and phase separation of said mixture of $^3$ He and $^4$He liquid and forming a phase boundary separating a first phase of concentrated $^3$He liquid and a second phase of a dilute mixture of $^3$He and $^4$He liquid;
means for holding said second phase, said holding means in communication with said containing means such that said second phase in said holding means forms a continuous path to said containing means and the liquid levels being nearly the same in said containing means and said holding means; and
means for pumping on said holding means and removing $^3$He gas from said holding means to cause the $^3$He in said concentrated $^3$He liquid to cross said phase boundary between said first phase and said second phase, the $^3$He continuing to cross said phase boundary until the depletion of said first phase in said containing means.

2. The helium dilution refrigeration system as defined in claim 1 wherein said means for liquifying comprises:

means for supplying $^4$He gas;
means for cooling said $^4$He gas and condensing liquid $^4$He;
means for pumping on said liquid $^4$He; and
means for collecting said $^4$He liquid, said collecting means cooled below 4° K. by pumping thereon with said pumping means.

3. The helium dilution refrigeration system as defined in claim 1 wherein said means for liquifying comprises a container of liquid $^4$He.

4. The helium dilution refrigeration system as defined in claim 3 wherein said liquid $^4$He is provided from a bath of said $^4$He liquid in said system.

5. The helium dilution refrigeration system as defined in claim 1 further including means for precooling said refrigeration system to liquid nitrogen temperatures.

6. The helium dilution refrigeration system as defined in claim 1 wherein said system achieves temperatures of at least about 0.02° K.

7. A helium dilution refrigeration system operable over a limited time period for cooling purposes, comprising:

means for supplying a mixture of $^3$He and $^4$He gas;
means for cooling selected portions of said refrigeration system to liquid helium temperatures;
means for liquifying helium gases;
means for collecting $^3$He liquid condensed from $^3$He gas cooled by said means for liquifying helium gases;
means for containing a mixture of $^3$He and $^4$He liquid condensed from said $^3$He and $^4$He gas cooled by said means for liquifying, said containing means cooled by said means for collecting $^3$He liquid and said collecting means causing cooling and phase separation of said mixture of $^3$He and $^4$He liquid and forming a phase boundary separating a first phase of concentrated $^3$He liquid and a second phase of a dilute mixture of $^3$He and $^4$He liquid;
means for holding said second phase, said holding means in communication with said containing means such that said second phase in said holding means forms a continuous path to said containing means and the liquid levels being nearly the same in said containing means and said holding means; and
means for pumping on said holding means and removing $^3$He gas from said holding means and causing dilution cooling by the $^3$He in said concentrated $^3$He liquid crossing said phase boundary between said first phase and said second phase, the $^3$He continuing to cross said phase boundary until the depletion of said first phase in said containing means and the $^3$He gas pumped from said holding means and collected by means for storing said $^3$He in preparation for use in the next operational period of said helium refrigeration system.

8. A helium dilution refrigeration system operable over a temporary time period for cooling purposes, comprising:

means for supplying $^3$He gas;

means for supplying a mixture of $^3$He and $^4$He gas;

means for cooling selected portions of said refrigeration system to liquid helium temperatures;

means for cooling said $^4$He gas and condensing liquid $^4$He;

means for pumping on said $^4$He liquid;

means for collecting said $^4$He liquid, said collecting means cooled below 4° K. by pumping thereon with said pumping means;

means for collecting $^3$He liquid condensed from $^3$He gas cooled by said $^4$He liquid collecting means;

means for containing a mixture of $^3$He and $^4$He liquid condensed from said $^3$He and $^4$He gas cooled by said $^4$He liquid collecting means, said containing means cooled by said means for collecting $^3$He, liquid and said collecting means causing cooling and phase separation of said mixture of $^3$He and $^4$He liquid and forming a phase boundary separating a first phase of concentrated $^3$He liquid and a second phase of a dilute mixture of $^3$He and $^4$He liquid;

means for holding said second phase, said holding means at substantially the same vertical level as said containing means and enclosing a small cross sectional area relative to the cross sectional area of said containing means and said holding means in communication with said containing means such that said second phase can form a continuous liquid path between said holding means and said containing means with the liquid levels being nearly the same in said containing means and said holding means; and means for pumping on said holding means and removing $^3$He gas from said holding means, dilution cooling caused by the $^3$He crossing said phase boundary between said first phase and said second phase and the $^3$He in said concentrated $^3$He liquid continuing to cross said phase boundary until the depletion of said first phase in said containing means.

9. The helium dilution refrigeration system as defined in claim 8 wherein said system contains a substantially constant amount of said second phase and upon depletion of said first phase in said containing means during said dilution cooling process, said containing means is substantially empty of said second phase liquid.

10. The helium dilution refrigeration system as defined in claim 9 wherein said holding means contains a relatively small amount of said second phase.

11. A compact, self-contained helium dilution refrigeration system recyclable for cooling purposes over limited time periods, comprising:

a containment vessel for supporting said refrigeration system;

means for supplying a mixture of $^3$He and $^4$He gas;

means for pumping said $^3$He and $^4$He gases, said pumping means disposed within said containment vessel;

means for cooling selected portions of said refrigeration system to liquid helium temperatures;

means for liquifying helium gases;

means for collecting said $^3$He liquid condensed from said $^3$He gas cooled by said liquifying means;

means for containing a mixture of $^3$He and $^4$He liquid condensed from said $^3$He and $^4$He gas cooled by said means for liquifying, said containing means cooled by said means for collecting $^3$He liquid and said collecting means causing cooling and phase separation of said mixture of $^3$He and $^4$He liquid and forming a phase boundary separating a first phase of concentrated $^3$He liquid and a second phase of a dilute mixture of $^3$He and $^4$He liquid;

means for holding said second phase, said holding means in communication with said containing means such that said second phase in said holding means forms a continuous liquid path to said containing means and the liquid levels being nearly the same in said containing means and said holding means; and means for pumping on said holding means and removing $^3$He gas from said holding means, dilution cooling caused by the $^3$He in said concentrated $^3$He liquid crossing said phase boundary between said first phase and said second phase and the $^3$He continuing to cross said phase boundary until the depletion of said first phase in said containing means.

12. A helium dilution refrigeration system operable over a limited time period for cooling purposes, comprising:

means for supplying $^4$He gas;

means for supplying a mixture of $^3$He and $^4$He gas;

means for cooling selected portions of said refrigeration system to liquid helium temperatures;

means for cooling said $^4$He gas and condensing $^4$He liquid;

means for pumping on said $^4$He liquid;

means for collecting said $^4$He liquid, said collecting means cooled below 4° K. by pumping thereon with said pumping means;

means for collecting $^3$He liquid condensed from $^3$He gas cooled by said $^4$He liquid collecting means;

means for containing a mixture of $^3$He and $^4$He liquid condensed from said $^3$He and $^4$He gas cooled by said $^4$He liquid collecting means, said containing means cooled by said means for collecting $^3$He liquid and said collecting means causing cooling and phase separation of said mixture of $^3$He and $^4$He liquid and forming a phase boundary separating a first phase of concentrated $^3$He liquid and a second phase of a dilute mixture of $^3$He and $^4$He gas;

means for holding said second phase, said holding means in communication with said containing means such that said second phase in said holding means forms a continuous path to said containing means and the liquid levels being nearly the same in said containing means and said holding means; and means for pumping on said holding means and removing $^3$He gas from said holding means, dilution cooling caused by the $^3$He in said concentrated $^3$He liquid crossing said phase boundary between said first phase and said second phase and the $^3$He continuing to cross said boundary until the depletion of said first phase in said containing means and said removed $^3$He gas substantially retained within said pumping means in preparation for the next period of operation of said refrigeration system.

13. The helium dilution refrigeration system as defined in claim 12 wherein said pumping means comprises a cryopump.

14. The helium dilution refrigeration system as defined in claim 12 further including means for controlling operation of said refrigeration system, said controlling means including a computer and associated computer programs with said computer monitoring physical parameters and generating control signals responsive to said monitored physical parameters and execution of said computer programs.

15. The helium dilution refrigeration system as defined in claim 14 wherein said physical parameters comprise gas pressure values and temperatures at selected locations in said system.

16. The helium dilution refrigeration system as defined in claim 14 wherein said system includes various heaters for controlling operation of said refrigeration system, said computer adapted for activation and deactivation of the power to said heaters responsive to said control signals.

17. The helium dilution refrigeration system as defined in claim 12 wherein said system achieves temperatures of at least about 0.02° K.

* * * * *